US006009599A

United States Patent [19]

Park

[11] Patent Number: 6,009,599

[45] Date of Patent: Jan. 4, 2000

[54] BURGLAR-PROOF APPARATUS FOR A VENDING MACHINE

[75] Inventor: Kyung-Jun Park, Kwangju, Rep. of Korea

[73] Assignee: Kwangiu Electronics Co., Ltd., Kwiangiu, Rep. of Korea

[21] Appl. No.: 08/984,269

[22] Filed: Dec. 3, 1997

[30] Foreign Application Priority Data

Jul. 1, 1997 [KR] Rep. of Korea ..... 97-30507

[51] Int. Cl.[7] ..... E05D 11/10; E05D 7/00

[52] U.S. Cl. ..... 16/380; 312/329

[58] Field of Search ..... 16/380, 266; 221/154; 312/326, 329

[56] References Cited

U.S. PATENT DOCUMENTS

| | | | |
|---|---|---|---|
| 3,659,314 | 5/1972 | Ross | 16/380 |
| 3,973,289 | 8/1976 | Yulkowski | 16/266 |
| 4,381,877 | 5/1983 | Stark | 16/380 |

*Primary Examiner*—Anthony Knight
*Attorney, Agent, or Firm*—Perman & Green, LLP

[57] ABSTRACT

This invention relates to a burglar-proof apparatus for a vending machine having burglar-proof means intended to be operated together with an upper hinge and installed an inner upper side of a main body to which a door is coupled, by which the separation of the door from the main body is prevented regardless of any metal rod based trial of uncoupling of the upper hinge. According to the present invention, there is provided a burglar-proof apparatus for a vending machine, the apparatus being intended to prevent any articles and money in a main body of the vending machine from being stolen through the use of an upper hinge and a lower hinge, the upper hinge having one side thereof installed at the main body by means of a projection and other side thereof installed at a door, characterized in that one end of said projection is provided with a projection panel by means of a fixing bolt, and an inner upper side of the main body to which the door is coupled is provided with burglar-proof preventing means which is organically operated with the projection panel to prevent the separation of the door from the main body.

4 Claims, 5 Drawing Sheets

BURGLAR-PROOF APPARATUS FOR A VENDING MACHINE

BACKGROUND OF THE INVENTION

1. FIELD OF THE INVENTION

The present invention relates to vending machines suitable for selling beverages, various type of goods, etc., and more particularly to a burglar-proof apparatus for the vending machines for preventing those articles disposed in a main body and money stored inside a door from being stolen.

2. DESCRIPTION OF THE PRIOR ART

Generally, vending machines can be classified into various types of machines depending upon kinds of articles available from those machines; a vending machine adapted to provide beverage filled in such as a disposable paper cup; and another vending machine adapted to provide such as a can or the like; and still another type of a vending machine used for providing various different kinds of articles like a lottery ticket, beverage, etc. According to the present invention, there is illustrated for a burglar-proof apparatus for the above-mentioned cup-based vending machine.

As shown in FIG. 1, an exterior appearance of the above type of the vending machine includes a main body 100 which forms an appearance and has a door 200 positioned at front surface of the body 100, for opening or closing the inside of the body 100. At an outer side of the door 200 is installed a handle 211 used when the door 200 is to be opened or closed, and a slit 212 for inserting coins in order to obtain desired beverages. Further, the door 200 has a beverage selection portion 213 in which push buttons are provided for selecting desired beverages, and a beverage taking portion 214 adapted to take a beverage therefrom by a user. Also, a user can receive, as coins, difference in amount between the inserted amount and the sale price of the beverage selected through a coin outlet 215.

Inside of door 200 as illustrated in FIG. 2, there are provided a coin chute 231 to slidably guide the coins inserted through the slit 212, a coin mechanism 232 arranged downstream of said coin chute 231 and functioning to discriminate if the correct coins are inserted, a change storage 233 integrally coupled to the coin mechanism 232, a guide 234 coupled to a lower side of the change storage 233 and for guiding coins corresponding to difference in amount between the inserted coin amounts and the sale price of a beverage into the coin outlet 215, and a coin box 236 for depositing final coins traveled through a duct 235 which is coupled to the coin mechanism 232.

Inside of the main body 100 as illustrated in FIG. 3, there are provided a water tank 111 for storing hot water, a plurality of material storing boxes 112 located downstream of the water tank 11 and for storing respective powder materials, a cup depositing box 113 located at a side of the material storing boxes 112 and for storing cups, a cup stand 115 capable of supporting the cup received through a passage 114, which is located downstream of the cup depositing box 113, and a container 117, at a lower side of the cup housing 115, for temporarily storing powder material or water discharged through a drain hose 116.

In order to obtain a desired beverage from the machine, a user is required to insert coins through the slit 212 and then to push one button selected in the a beverage selection portion 213. At this time, a cup having been stored in the cup depositing box 113 is supplied into the cup stand 115, followed by the supplying of desired beverage into the discharged cup by a predetermined amount. Upon the completing of the beverage supply, a user can take the beverage-contained cup from the beverage taking portion 214. After this procedures, the vending machine gives a user coins corresponding to difference in amount between the inserted coin amounts and the sale price of a beverage through the coin outlet 215.

At this time, powder material or water may be discharged outside of the cup during the supplying of material or water, but which can be collected in the container 117 which would be cleaned by an operator.

Such a vending machine is also provided with a burglar-proof apparatus for preventing the money in the coin box 236 and various valuable things inside the main body 100 from being stolen, as shown in FIG. 4.

In the prior art burglar-proof apparatus, there has been employed upper hinge 300 and lower hinge (not shown) operated when the door 200 of the body 100 is opened or closed.

More specifically, to an upper side of the main body 100 is operatively coupled an end of one side of the door 200. On both top surfaces of the main body 100 and door 200, there is provided the upper hinge 300 for a hinge action of the door 200. To this end, the upper hinge 300 has one side thereof coupled to the main body 100 and other side thereof from which a protrusion 310 is integrally, downward extended. Since the protrusion 310 is inserted into the door 200 to provide a hinge action of the door 200, separation of the door 200 from the main body 100 is prevented for the burglar-proof.

However, there is problem in that the above-mentioned burglar-proof apparatus for the vending machine has only upper and lower hinges, so an effective burglar-proof cannot be guaranteed.

In other words, the space X defined between the main body 100 to which the upper hinge 300 is installed and the door 200 can be used to insert therebetween relatively long metallic rod for an intended separation of the door 200 from the main body 100. An external force constantly applied thereto causes an easy separation of the protrusion 310 of the upper hinge 300 from the door 200, leading to the separation of the door 200 from the main body 100.

SUMMARY OF THE INVENTION

Therefore, it is an object of the present invention to provide a burglar-proof apparatus for a vending machine having burglar-proof means intended to be operated together with an upper hinge and installed an inner upper side of a main body to which a door is coupled, by which the separation of the door from the main body is prevented regardless of any metal rod based trial of uncoupling of the upper hinge.

To accomplish the above objects of the present invention, there is provided a burglar-proof apparatus for a vending machine, the apparatus being intended to prevent any articles and money in a main body of the vending machine from being stolen through the use of an upper hinge and a lower hinge, the upper hinge having one side thereof installed at the main body by means of a projection and other side thereof installed at a door, characterized in that one end of said projection is provided with a projection panel by means of a fixing bolt, and an inner upper side of the main body to which the door is coupled is provided with burglar-proof preventing means which is organically operated with the projection panel to prevent the separation of the door from the main body.

The burglar-proof preventing means comprises: a first bracket having through holes formed therein and spaced apart from each other by a predetermined distance;

a second bracket having a body portion in which insertion holes communicating with the through holes are formed therein and a bending upright extension extended upward from one end of the body portion; a first bolt having one end formed through the insertion hole and then the through hole to be fixed at an inner upper surface of the body; and a second bolt having one end formed through the insertion hole to be coupled to a fixing member and further formed through the through hole to be fixed at the inner upper surface of the body.

Said first bolt comprises: a coupling portion with a screwed portion around one outer side thereof and for fixing at the inner upper surface of the body; a supporting portion integrally formed at other outer side of the coupling portion and for supporting a lower portion of the second bracket; and an annular extension at a predetermined position of the coupling portion and for preventing the bending of the second bracket towards the door, which can occur due to an external force applied.

The second bolt comprises: a coupling portion with a screwed portion 551 around one outer side thereof and for fixing at the inner upper surface of the body, a supporting portion integrally formed at the outer side of the coupling portion and for supporting a lower portion of the second bracket; and annular extensions, each being vertically arranged between the screwed portion and the supporting portion, and for improving the coupling force to the fixing member.

The fixing member comprises: an opened fixing ring whose both ends are provided with respective coupling holes, a spring intended to be inserted between both ends of the ring; a fixing bolt having a fixing hole at its end portion and formed through the coupling hole and then the spring; and a fixing pin installed in the fixing hole and for preventing the uncoupling of the fixing bolt and fixing ring.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

A preferred first embodiment according to the present invention will now be described in detail in accordance with the accompanying drawings.

Figure 1:
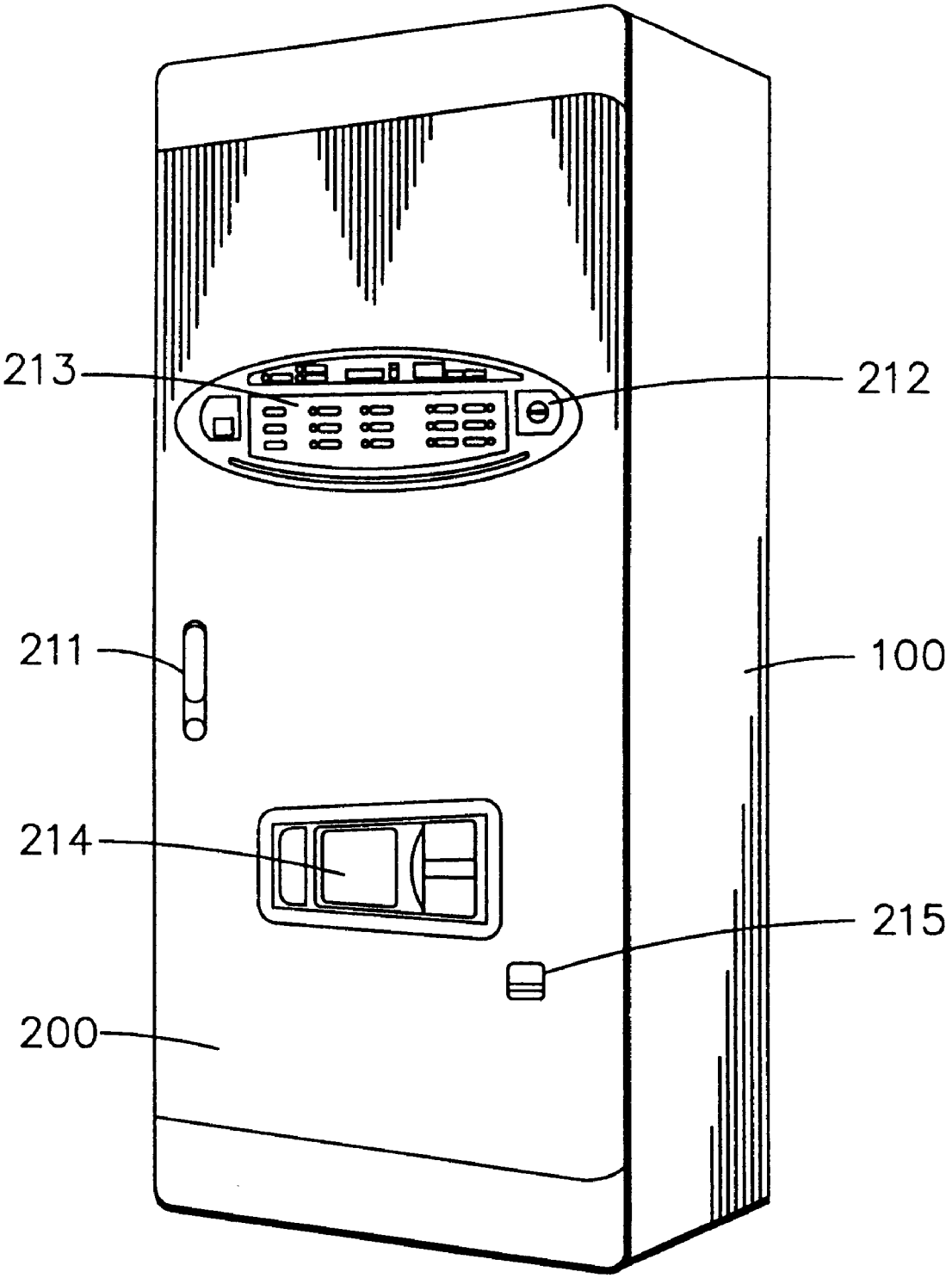
FIG. 1 is a perspective view of a conventional vending machine.
Figure 2:
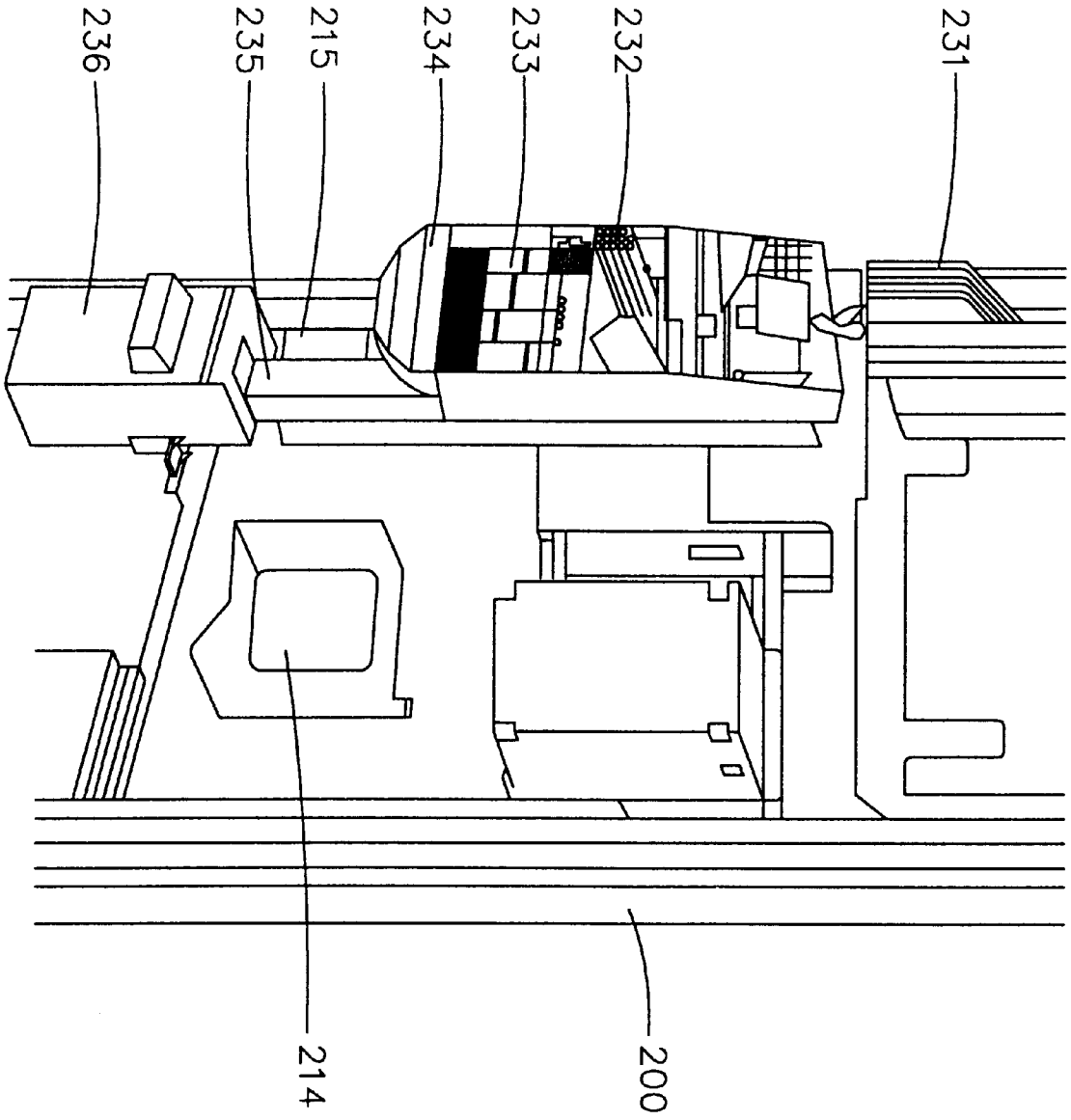
FIG. 2 is a view of an inner side of a door in FIG. 1.
Figure 3:
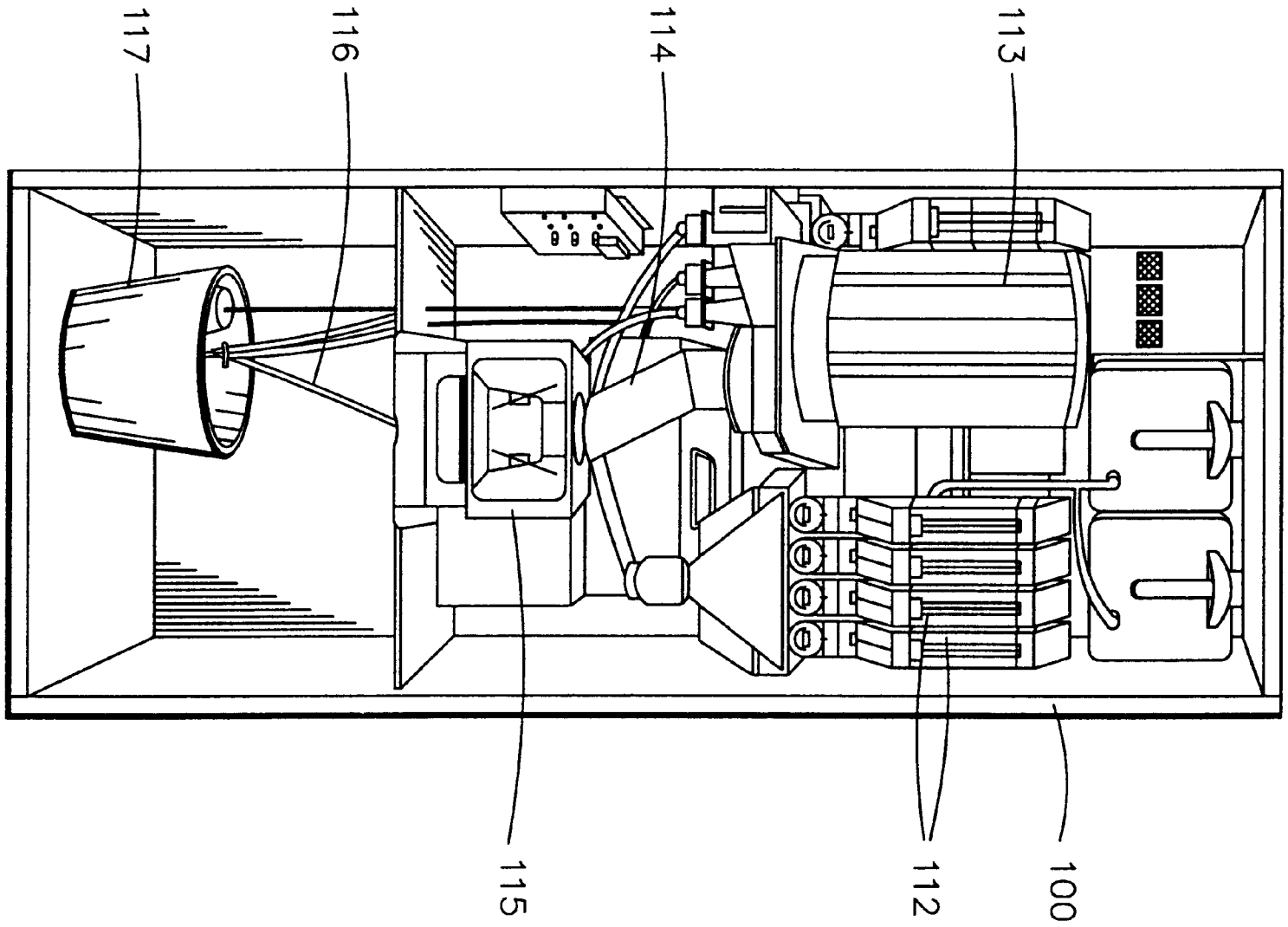
FIG. 3 is a plan view of an inner side of a main body in FIG. 1.
Figure 4:
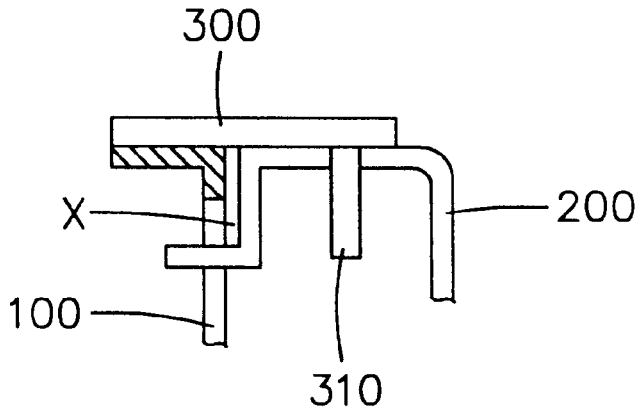
FIG. 4 is a schematic sectional view of an upper hinge for explaining a burglar-proof apparatus of the prior art.
Figure 5:
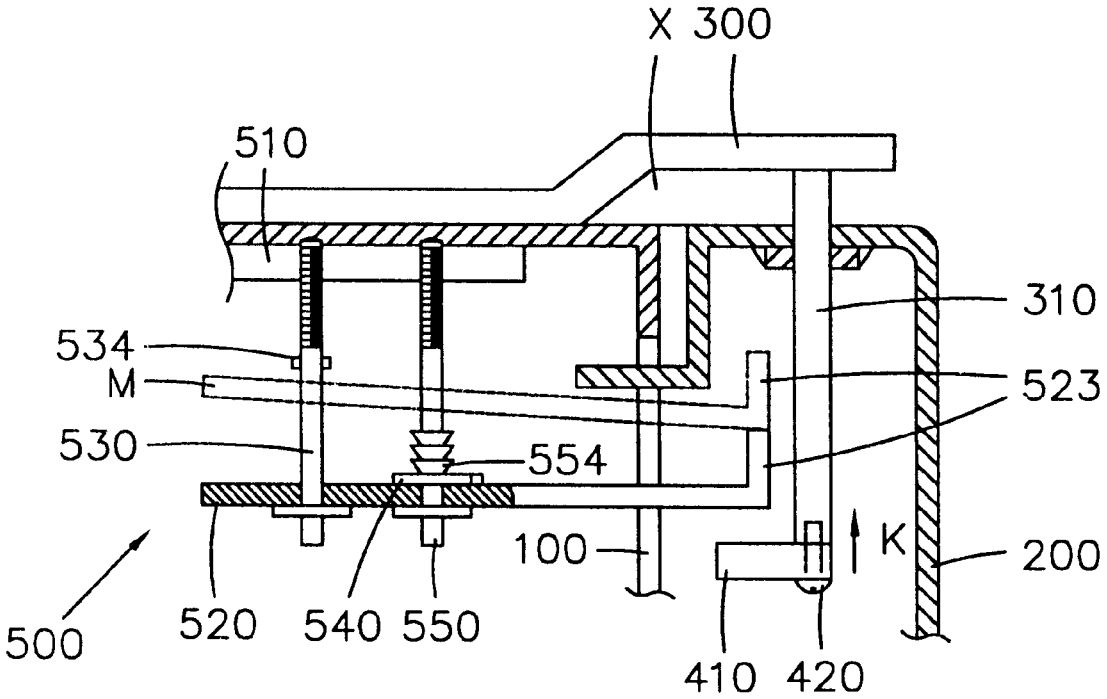
FIG. 5 is an exploded view of a burglar-proof apparatus according to the present invention.
Figure 6:
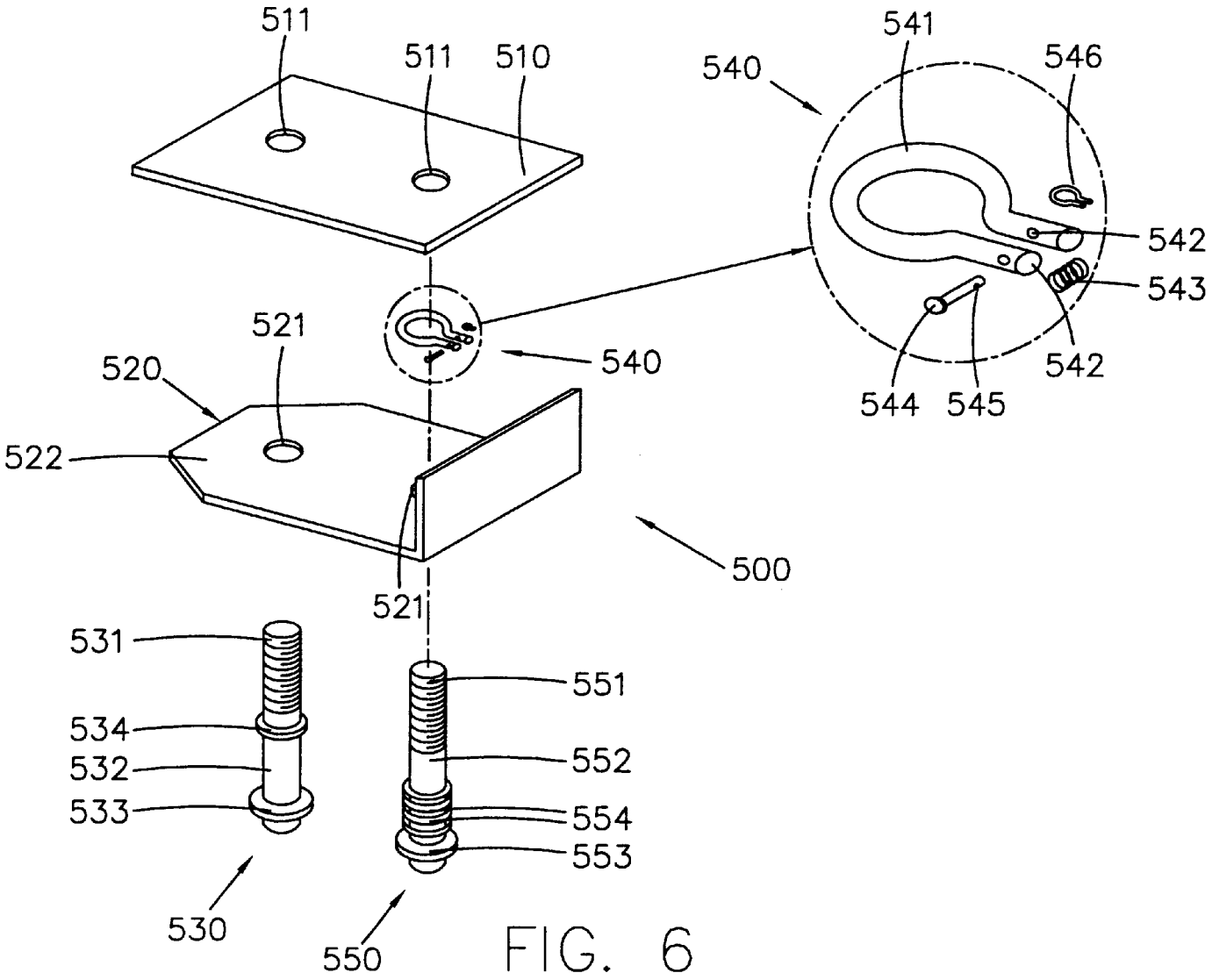
FIG. 6 is a sectional view for explaining an operation of the burglar-proof apparatus of the present invention.

FIG. 5 is a schematic sectional view of a burglar-proof apparatus for a vending machine according to the present invention, and FIG. 6 is an exploded, perspective view of the burglar-proof apparatus. The apparatus operates when an intended separation of an upper hinge 300 caused by an external force is made. The apparatus is installed inside an upper side of a main body 100, where the main body 100 and the door 200 are coupled to each other.

That is, as shown in FIG. 5, a protrusion 310 downwardly extended from the upper hinge 300 further has a protrusion plate 410 formed at its end portion, fastened by a fixing bolt 420.

As shown in FIG. 6, the burglar-proof apparatus 500, which is installed inside an upper side of a main body 100, includes a first bracket 510 having two through holes 511 formed therein and spaced apart from each other by a predetermined distance, a second bracket 520 having a body portion 522 in which two insertion holes 521 communicating with the through holes 511 are formed therein and an upright extension 523 extended upward from one end of the body portion 522, a first bolt 530 having one end formed through the insertion hole 521 and the through hole 511 to be fixed at an inner upper surface of the body 100, and a second bolt 550 having one end formed through the insertion hole 521 to be coupled to a fixing member 540 and further formed through the through hole 511 to be fixed at the inner upper surface of the body 100.

The first bolt 530 includes a coupling portion 532 with a screwed portion 531 around one outer side thereof and for fixing at the inner upper surface of the body 100, a supporting portion 533 integrally formed at other outer side of the coupling portion 532 and for supporting a lower portion of the second bracket 520, and an annular extension 534 at a predetermined position of the coupling portion 532 and for preventing the bending of the second bracket 520 towards the door 200, which can occur due to an external force applied.

The second bolt 550 includes a coupling portion 552 with a screwed portion 551 around one outer side thereof and for fixing at the inner upper surface of the body 100, a supporting portion 553 integrally formed at other outer side of the coupling portion 552 and for supporting a lower portion of the second bracket 520, and annular extensions 554, each being vertically arranged between the screwed portion 551 and the supporting portion 553, and for improving the coupling force to the fixing member 540.

The fixing member 540 consists of an opened fixing ring 541 whose both ends are provided with respective coupling holes 542, and a spring 543 intended to be inserted between both ends of the ring 541, a fixing bolt 544 having a fixing hole 545 at its end portion and formed through the coupling hole 542 and then the spring 543, and a fixing pin 546 installed in the fixing hole 543 and for preventing the uncoupling of the fixing bolt 544 and fixing ring 541.

The operation and advantages of the burglar-proof apparatus in accordance with the present invention will be discussed below with reference to FIGS. 5 and 6.

The first and second brackets 510, 520, first and second bolts 530, 550 and fixing member 540, these elements constituting the burglar-proof apparatus as shown in FIG. 6, are at first assembled, which is subsequently installed in the inner upper portion of the main body 100 to which the door 200 is coupled, through the use of the first and second bolts 530, 550.

Relatively long metal rod may be inserted in the space X defined between the main body 100 and the door 200, and then a constant external force is applied through the rod to lift the upper hinge 300. Then, the protrusion 310 integrally formed at the upper hinge 300 is also moved upwards, as illustrated by an arrow K in FIG. 5, followed by an ascending of the protrusion plate 410.

The ascending of the protrusion plate 410 causes the protrusion plate 410 to be in contact with the lower portion of the second bracket 520. As the protrusion plate 410 moves upwards, the second bracket 520 finally reaches a position M, as illustrated in a dotted line in FIG. 5.

At this time, the fixing member 540, which also ascends while the second bracket 520 moves upwards, becomes tightly fixed at a position at which the ascending of the second bracket 520 has been completed.

That is, during the ascending of the second bracket 520, both ends of the fixing ring 541 as shown in FIG. 6 are gradually widened, so that the ring 541 can ascend together with the second bracket 520. When the ascending of second bracket 520 is stopped at the end portion of the door 200, both ends of the fixing member 540 are narrowed again by restitution force of the spring, which ensures that the fixing member 540 is fixed at a position of the annular extensions 554.

The second bracket 520 ascends and then is finally engaged with the end portion of the door 200, and at the same time, the bent and upright extension 523 of the second bracket 520 is hung on the end portion of the door 200. Even if an external force is applied to pull the door 200, the separation of the door from the main body 100 can be prevented.

Since the burglar-proof apparatus consists of the upper hinge, the projection plate at the projection 310 of the upper hinge and burglar-proof means in the inner upper side of the main body, the door is not separated from the main body although external force is applied.

What is claimed is:

1. A burglar-proof apparatus for a vending machine, the apparatus being installed inside an upper side of a main body of the machine to prevent separation of a door from the main body, and the apparatus including an upper and a lower hinge respectively hinge-coupling an upper and lower end of the door, and a protrusion downwardly extended from the upper hinge, wherein the apparatus comprises:

a protrusion plate connected generally perpendicularly to the length of said protrusion via a fixing bolt;

a first bracket having through holes formed therein and spaced apart therebetween by a predetermined distance;

a second bracket having a body portion in which insertion holes communicating with the through holes are formed therein and a perpendicularly turned extension extended upward from one end of the body portion;

a first bolt having one end passing through the insertion hole and then through the through hole and secured to an inner upper surface of the body; and a second bolt having one end passing through the insertion hole and coupled to a fixing member and passing through the through hole and secured to the inner upper surface of the body.

2. The apparatus of claim 1 wherein the first bolt comprises:

a coupling portion with a threaded portion around one outer side thereof for fixing the inner upper surface of the body;

a supporting portion integrally formed at the other outer side of the coupling portion for supporting a lower portion of the second bracket; and an annular extension formed at a predetermined position of the coupling portion and for preventing the bending of the second bracket towards the door.

3. The apparatus of claim 1, wherein the second bolt comprises:

a coupling portion with a threaded portion around one outer side thereof for fixing to the inner upper surface of the body;

a supporting portion integrally formed at the other outer side of the coupling portion for supporting a lower portion of the second bracket; and annular extensions, each being vertically arranged between the threaded portion and the supporting portion, for improving the coupling force to the fixing member.

4. The apparatus of claim 1, wherein the fixing member comprises:

an opened fixing ring having two ends both of which ends are provided with respective coupling holes;

a spring inserted between both ends of the ring;

a fixing bolt having a fixing hole at its end portion and passing through the coupling holes and the spring; and a fixing pin installed in the fixing hole for preventing the uncoupling of the fixing bolt and the fixing ring.

* * * * *